US009151190B2

(12) United States Patent
Noguchi et al.

(10) Patent No.: US 9,151,190 B2
(45) Date of Patent: Oct. 6, 2015

(54) VALVE TIMING CONTROLLER

(75) Inventors: Yuji Noguchi, Obu (JP); Kazunari Adachi, Chiryu (JP); Takeo Asahi, Nagoya (JP)

(73) Assignee: AISIN SEIKI KABUSHIKI KAISHA, Kariya-shi, Aichi (JP)

( * ) Notice: Subject to any disclaimer, the term of this patent is extended or adjusted under 35 U.S.C. 154(b) by 0 days.

(21) Appl. No.: 14/237,450

(22) PCT Filed: Sep. 26, 2011

(86) PCT No.: PCT/JP2011/072706
§ 371 (c)(1),
(2), (4) Date: Feb. 6, 2014

(87) PCT Pub. No.: WO2013/046474
PCT Pub. Date: Apr. 4, 2013

(65) Prior Publication Data

US 2014/0196676 A1 Jul. 17, 2014

(51) Int. Cl.
*F01L 1/34* (2006.01)
*F01L 1/344* (2006.01)

(52) U.S. Cl.
CPC ..... *F01L 1/3442* (2013.01); *F01L 2001/34479* (2013.01); *F01L 2001/34483* (2013.01); *F01L 2103/00* (2013.01)

(58) Field of Classification Search
CPC ..... F01L 1/3442; F01L 2001/34479; F01L 2103/00; F01L 2001/34483
USPC ..... 123/90.17
See application file for complete search history.

(56) References Cited

U.S. PATENT DOCUMENTS 6,039,016 A 3/2000 Noguchi
2001/0003974 A1 6/2001 Mizutani et al.

(Continued)

FOREIGN PATENT DOCUMENTS

DE 198 49 959 A1 5/1999
EP 1 795 715 A1 6/2007

(Continued)

OTHER PUBLICATIONS

Notification Concerning Transmittal of International Preliminary Report on Patentability (Chapter I of the Patent Cooperation)(Form PCT/IB/326 & Form PCT/IB/373) and the Written Opinion of the International Searching Authority (Form PCT/ISA/237) issued on Apr. 10, 2014, in the corresponding International Application No. PCT/JP2011/072706. (8 pages).

(Continued)

*Primary Examiner* — Zelalem Eshete
(74) *Attorney, Agent, or Firm* — Buchanan Ingersoll & Rooney PC

(57) ABSTRACT

A valve timing controller includes: a driving-side rolling body configured to rotate synchronously with an engine crankshaft; a driven-side rolling body configured to rotate in a unified manner with a camshaft for opening/closing an engine valve relative to the driving-side rolling body; an advance chamber, and a retard chamber; a torsion spring disposed in a space formed between a front plate or a rear plate of the driving-side rolling body and the driven-side rolling body and configured to bias at all times the driving-side rolling body and the driven-side rolling body in the advance direction or the retard direction; and a first cylindrical portion provided in the front plate or the rear plate and a second cylindrical portion provided in the driven-side rolling body, the first and second cylindrical portions being insertable into each other in an axial direction.

9 Claims, 3 Drawing Sheets

(56) References Cited

U.S. PATENT DOCUMENTS

| | | | |
|---|---|---|---|
| 2002/0100445 | A1 | 8/2002 | Takenaka et al. |
| 2002/0139332 | A1 | 10/2002 | Takenaka |
| 2004/0244746 | A1 | 12/2004 | Kinugawa |
| 2005/0284432 | A1 | 12/2005 | Tsukada |
| 2006/0137635 | A1 | 6/2006 | Hayashi |
| 2007/0240656 | A1 | 10/2007 | Ikihara |
| 2007/0266970 | A1 | 11/2007 | Ogawa |
| 2011/0061620 | A1 | 3/2011 | Noguchi et al. |
| 2011/0073056 | A1 | 3/2011 | Kobayashi et al. |

FOREIGN PATENT DOCUMENTS

| | | | |
|---|---|---|---|
| EP | 2 305 969 | A1 | 4/2011 |
| JP | 2001-173414 | | 6/2001 |
| JP | 2001-317314 | A | 11/2001 |
| JP | 2002-357106 | A | 12/2002 |
| JP | 2007-285200 | A | 11/2007 |

OTHER PUBLICATIONS

International Search Report (PCT/ISA/210) mailed on Jun. 29, 2012, by the European Patent Office as the International Searching Authority for International Application No. PCT/JP2011/072706.

Written Opinion (PCT/ISA/237) mailed on Jun. 29, 2012, by the European Patent Office as the International Searching Authority for International Application No. PCT/JP2011/072706.

Office Action (Notice of Reasons for Rejection) issued on Feb. 26, 2015, by the Japanese Patent Office in corresponding Japanese Patent Application No. 2014-509531 and an English translation of the Office Action. (5 pages).

VALVE TIMING CONTROLLER

TECHNICAL FIELD

The present invention relates to a valve timing controller including: a driving-side rolling body configured to rotate synchronously with a crankshaft of an internal combustion engine; a driven-side rolling body which is coaxially held in the driving-side rolling body through a sealing member and is configured to rotate in a unified manner with a camshaft for opening/closing a valve of the internal combustion engine, relative to the driving-side rolling body; an advance chamber configured to move a relative rotation phase of the driven-side rolling body relative to the driving-side rolling body in an advance direction by a volume increase of the advance chamber through an operating oil supply, and a retard chamber configured to move the relative rotation phase in a retard direction by a volume increase of the retard chamber through an operating oil supply, the advance chamber and the retard chamber being formed of the driving-side rolling body and the driven-side rolling body; and a torsion spring which is disposed in a space formed between a front plate or a rear plate of the driving-side rolling body and the driven-side rolling body and is configured to bias at all times the driving-side rolling body and the driven-side rolling body in the advance direction or the retard direction.

BACKGROUND ART

As the conventional valve timing controller, there can be mentioned a controller in which a torsion spring is provided between a driving-side rolling body and a driven-side rolling body. The torsion spring is provided for the purpose of, for example, canceling out a force in a retard direction acting on a camshaft so as to enhance responsiveness of phase variation of the camshaft, during the operation of an internal combustion engine.

Meanwhile, there are some cases in which a sealing member provided between the driving-side rolling body and the driven-side rolling body for the purpose of creating an advance chamber and a retard chamber. The sealing members are provided, for example, at positions in respective rolling bodies where two rolling bodies face each other. During the relative rotation of the two rolling bodies, even when the distance between the two rolling bodies is changed, each sealing member should firmly seal the gap between the rolling bodies with the use of a biasing spring or the like. However, in order to further enhance a sealing function of the sealing member, center alignment of the two rolling bodies should be performed at portions other than the sealing members.

In such a valve timing controller, in order to perform the center alignment of each member, the camshaft constitutes a component for the alignment. To put it another way, until all of the components are assembled, the center alignment of the driving-side rolling body and the driven-side rolling body is not performed.

The driving-side rolling body and the driven-side rolling body are assembled prior to the connection with the camshaft. Upon the assembly, in order to set the driving-side rolling body and the driven-side rolling body in an initial phase, a torsional torque has to be imparted to the torsion spring to some extent. Therefore, in the valve timing controller of such a type, various efforts have been made in order to firmly perform the connecting work of the camshaft, the center alignment work between the driving-side rolling body and the driven-side rolling body, or the like.

For example, in a case of a valve timing controller described in Patent Document 1, a bush is pressed into a vane rotor as driven-side rolling body. The bush has a function of retaining the vane rotor and a shoe housing as the driving-side rolling body on the same axis. The bush functions also as seat for receiving a bolt for connecting the camshaft to the vane rotor. The reason for this configuration of pressing the bush into the vane rotor is to accurately align the vane rotor with the bush.

CITATION LIST

Patent Literature

Patent Document 1: Japanese Unexamined Patent Application Publication no. 2001-173414 (see paragraph [0015] and FIG. 1)

SUMMARY OF INVENTION

Technical Problem

However, in the case of the device using such a bush, a number of the components is increased, and moreover, a number of manufacturing steps in which the bush is pressed into the vane rotor is increased. In addition, by pressing the bush into one side of the vane rotor, the vane rotor as a whole may be warped with a curvature protruding to a side opposite to the side into which the push is pressed. If the vane rotor has warpage, a gap is created between the vane rotor and the shoe housing when the valve timing controller is assembled. As a result, operating oil leaks from this gap and the responsiveness of advance-retard control becomes low. In order to correct the warpage of the vane rotor, it is possible that both faces of the vane rotor are ground to become flat. However, conducting such a process is not realistic, in view of production cost or the like.

The present invention was made with the view toward solving the above-mentioned problems of the prior art technique, and the object is provide a valve timing controller in which the driving-side rolling body and the driven-side rolling body are reasonably assembled.

Solution to Problem

The valve timing controller according to the present invention has a feature in that it includes: a driving-side rolling body configured to rotate synchronously with a crankshaft of an internal combustion engine; a driven-side rolling body which is coaxially held in the driving-side rolling body through a sealing member and is configured to rotate in a unified manner with a camshaft for opening/closing a valve of the internal combustion engine, relative to the driving-side rolling body; an advance chamber configured to move a relative rotation phase of the driven-side rolling body relative to the driving-side rolling body in an advance direction by a volume increase of the advance chamber through an operating oil supply, and a retard chamber configured to move the relative rotation phase in a retard direction by a volume increase of the retard chamber through an operating oil supply, the advance chamber and the retard chamber being formed of the driving-side rolling body and the driven-side rolling body; a torsion spring which is disposed in a space formed between a front plate or a rear plate of the driving-side rolling body and the driven-side rolling body and is configured to bias at all times the driving-side rolling body and the driven-side rolling body in the advance direction or the retard direction; and a first cylindrical portion provided in the front plate or the rear plate and a second cylindrical portion provided in the driven-side rolling body, the first and second cylindrical portions being insertable into each other in an axial direction.

<Effect>

With this configuration, the first cylindrical portion and the second cylindrical portion insertable into each other in the axial direction are separately provided on the driven-side rolling body and the front plate or rear plate, respectively. Therefore, the configurations of the driving-side rolling body and the driven-side rolling body can be simplified. To put it another way, without separately using a special member, the driving-side rolling body and the driven-side rolling body can be aligned. As a result, the valve timing controller can be obtained with which the number of components is reduced and the assembly work is simplified.

In the valve timing controller according to the present invention, a recess can be provided in one side face of the driven-side rolling body, into which recess an end portion of the camshaft is insertable, and an opening diameter of the recess can be made larger than an inner diameter of a hole formed in the rear plate into which the camshaft is insertable.

<Effect>

When the valve timing controller is assembled, first the driven-side rolling body is held in the driving-side rolling body and then the camshaft is connected to the driven-side rolling body. In the device of the present configuration, by alternately inserting the first cylindrical portion and the second cylindrical portion into each other, both members can be aligned within a predetermined region. However, since both members should rotate relative to each other, a gap should be present between the two members upon the operation of the device. Moreover, since the torsion spring is disposed across the driving-side rolling body and the driven-side rolling body, the driving-side rolling body and the driven-side rolling body tends to be eccentric due to a spring force. In the device of the present configuration, by making the opening diameter of the recess formed in the driven-side rolling body larger than the inner diameter of a hole formed in the rear plate, the hole is easily positioned within a range of the recess when the recess is seen in a shaft center direction from a side of the hole. In other words, when the driving-side rolling body and the driven-side rolling body are assembled but they become eccentric, an end face of the camshaft is unlikely to be brought into contact with a portion further outside the recess of the driven-side rolling body, and thus the insertion of the camshaft is less hindered. As a result, the end portion of the camshaft can be firmly inserted into the recess. As described above, in the device of the present configuration, the connection of the camshaft to the driven-side rolling body can be performed remarkably smoothly.

In the valve timing controller according to the present invention, the second cylindrical portion can be formed in an end face on an opposite side to a side of the camshaft from among end faces of the driven-side rolling body, and the first cylindrical portion can be set outside the second cylindrical portion.

<Effect>

The second cylindrical portion provided in the driven-side rolling body is formed on an opposite side to a side on which the camshaft is attached. Inward of the second cylindrical portion, a bolt is disposed which is for fixing the camshaft to the driven-side rolling body. With this configuration, the first cylindrical portion is positioned outside the second cylindrical portion, and thus an end face of the second cylindrical portion can be utilized as, for example, seat with which a head of the bolt comes into contact. With this configuration, the valve timing controller can be formed more reasonably.

In the valve timing controller according to the present invention, an annular groove can be formed in an end face on an opposite side to a side of the camshaft from among end faces of the driven-side rolling body, and an inner diameter-side wall of the annular groove can serve as the second cylindrical portion.

<Effect>

As in the present configuration, for obtaining the second cylindrical portion, the annular groove is formed in the end face of the driven-side rolling body. In this case, for example, a shape of a base material forming the driven-side rolling body can be a simple approximate column shape. If the column shape is enough as a basic shape of the driven-side rolling body, it can be obtained by firstly shaping an elongated member with extrusion molding of aluminum or the like, and then cutting the member into pieces each having a predetermined size. Therefore, the valve timing controller can be efficiently manufactured.

In the valve timing controller according to the present invention, an inner periphery of a hole formed in the rear plate and an outer diameter face of the camshaft can constitute a bearing.

<Effect>

It is desired that the driving-side rolling body and the driven-side rolling body rotate relative to each other as coaxially as possible. In this configuration, the camshaft and the rear plate form a bearing in such a manner that an outer periphery of the camshaft is taken as a base plane of the rotation. The driven-side rolling body is formed in a unified manner with the camshaft. Accordingly, as described above, by setting the basis of the rotation of both the driving-side rolling body and the driven-side rolling body to the camshaft, assembly accuracy of the valve timing controller can be enhanced.

DESCRIPTION OF EMBODIMENTS

First Embodiment (Entire Configuration)

Hereinbelow, a valve timing controller according to the present invention will be described with reference to the drawings.

Figure 1:
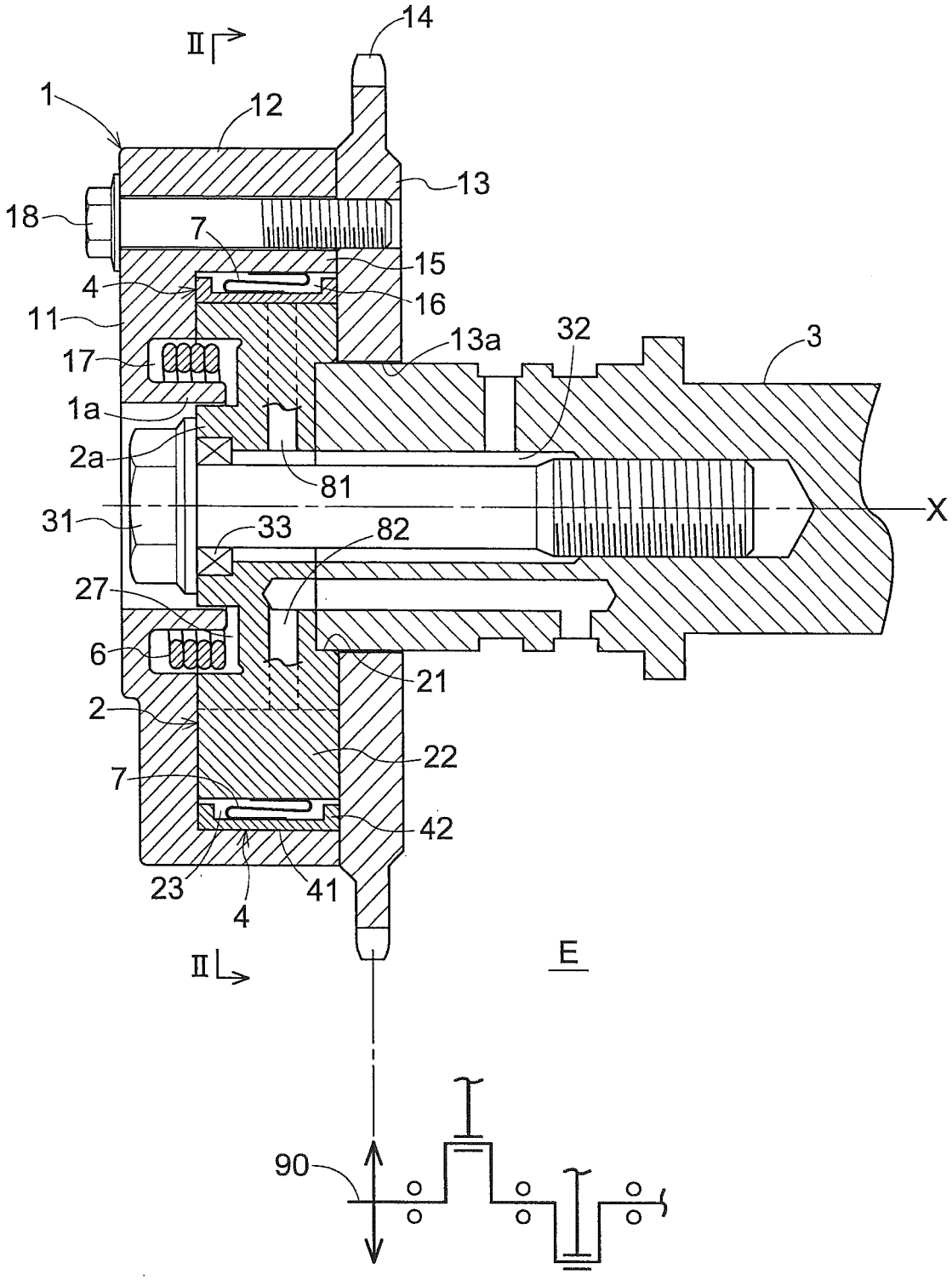
FIG. 1 is a cross-sectional side view of a valve timing controller according to a first embodiment.
Figure 2:
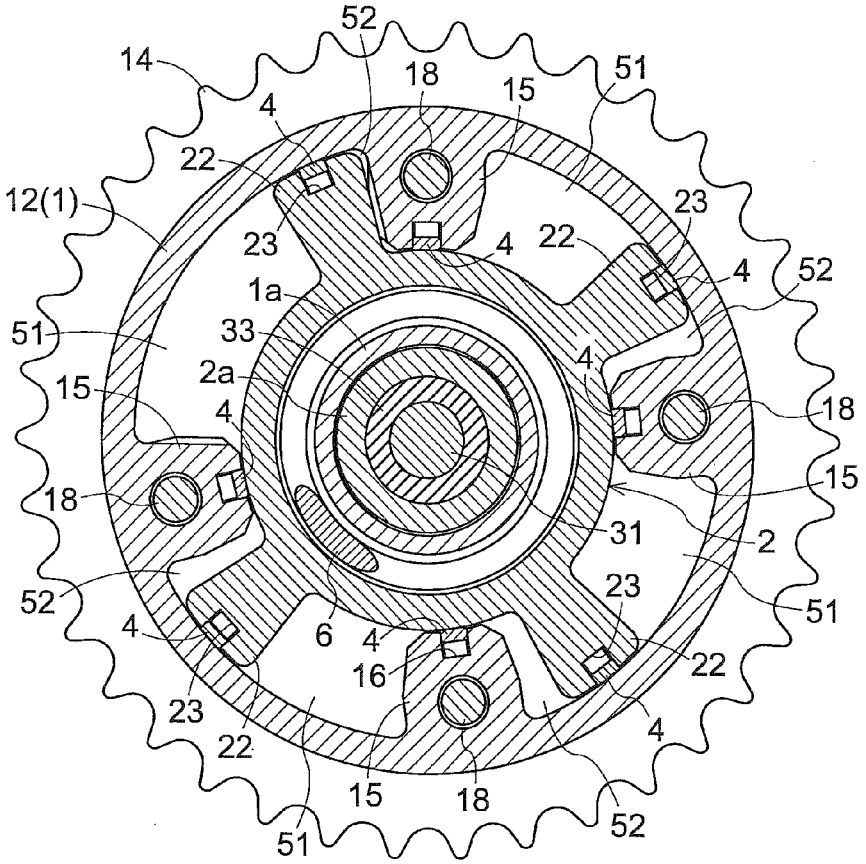
FIG. 2 is a cross-sectional view taken along a line II-II in FIG. 1.

As shown in FIGS. 1 and 2, the controller includes: a housing 1 (one example of a driving-side rolling body) configured to rotate synchronously with a crankshaft 90 of an internal combustion engine E; and an inner rotor 2 (one example of a driven-side rolling body) which is formed in a unified manner with a camshaft 3 for opening/closing a valve of the internal combustion engine E and configured to rotate relative to the housing 1. The inner rotor 2 is contained in the housing 1, and sealing members 4 are provided between the inner rotor 2 and the housing 1. Between the housing 1 and the inner rotor 2, there are provided: an advance chamber 51 configured to move the inner rotor 2 relative to the housing 1 in an advance direction by a volume increase of the advance chamber 51 through operating oil supply; and a retard chamber 52 configured to move the inner rotor 2 in a retard direction in a similar manner. Further, between the housing 1 and the inner rotor 2, there are provided a torsion spring 6 configured to bias at all times the inner rotor 2 to the housing 1 in the advance direction or the retard direction.

As shown in FIG. 1, the housing 1 includes: a front plate 11 disposed on a side opposite to a side on which the camshaft 3 is connected; a peripheral wall 12 integrally formed with the front plate 11; and a rear plate 13 having a sprocket 14 to which a driving force of the crankshaft 90 is input. The housing 1 is in a shape of an approximate cylinder.

In the housing 1, the inner rotor 2 is contained. In one face of the inner rotor 2, a connection recess 21 is formed, and to the connection recess 21, the camshaft 3 is assembled in a unified manner.

As shown in FIG. 2, an inner periphery of the housing 1 has a plurality of first projections 15 formed along a circumferential direction which protrude inward in a radial direction. On the other hand, an outer periphery of the inner rotor 2 has a plurality of second projections 22 formed along the circumferential direction which protrude outward in the radial direction. The first projection 15 adjacently faces the outer periphery of the inner rotor 2, while the second projection 22 adjacently faces the inner periphery of the housing 1.

The first projection 15 and the second projection 22 have a groove 16 and a groove 23 formed therein, respectively. Each of the grooves 16,23 includes: the sealing member 4; and a spring member 7 configured to bias the sealing member 4 in such a manner that the sealing members 4 protrude out of the grooves 16,23. The sealing member 4 includes: a plate-like body portion 41 extending along an axis X; and a pair of legs 42 protruding in the radial direction of the axis X from both end portions of the body portion 41 towards a bottom of the groove. The spring member 7 is disposed between the legs 42.

With these first projections 15 and second projections 22, a plurality of the advance chambers 51 and the retard chambers 52 are formed side-by-side in a rotational direction. As shown in FIG. 1, the inner rotor 2 and the camshaft 3 have advance oil passages 81 in communication with the respective advance chambers 51, and retard oil passages 82 in communication with the respective retard chambers 52. Operating oil is alternately supplied to and discharged from the advance oil passage 81 and the retard oil passage 82 using an oil supply-discharge mechanism (not shown), to thereby alternately expand and alternately contract the advance chamber 51 and the retard chamber 52. With this configuration, the inner rotor 2 is moved relative to the housing 1 in the advance direction or the retard direction, to thereby retain the housing 1 and the inner rotor 2 in a desired relative phase.

As shown in FIGS. 1 and 2, the torsion spring 6 is disposed across the inner rotor 2 and the housing 1. The torsion spring 6 is, for example, configured to bias the inner rotor 2 in the advance direction or the retard direction, against a reaction force from an intake valve or an exhaust valve generated when the camshaft 3 is rotated. The torsion spring 6 is, for example, a member in a shape of a coil. When the inner rotor 2 and the housing 1 are assembled, the torsion spring 6 is already imparted with an initial biasing force to some extent, in order to set the inner rotor 2 in an initial phase relative to the housing 1. Accordingly, when the inner rotor 2 and the housing 1 are just assembled, they become misaligned to a predetermined amount due to the biasing force of the torsion spring 6. In the device of the present invention, this problem of the misalignment is solved in the following manner.

For installing the valve timing controller into the internal combustion engine E, first, the torsion spring 6 is placed inside the housing 1. The torsion spring 6 is placed in an annular recess 17 formed in the front plate 11 of the housing 1. Next, the inner rotor 2 is attached to the housing 1, and then the sealing members 4 and the spring members 7 are attached. Upon this attachment, the inner rotor 2 is relatively displaced in either of the rotational directions. Further, the rear plate 13 is attached, and then the front plate 11 and the rear plate 13 are fastened with housing bolts 18 at a plurality of positions arranged circumferentially.

In the present invention, the front plate 11 and the inner rotor 2 have a projection and a recess which are insertable into each other along the axis X. As shown in FIG. 1, the front plate 11 has a first cylindrical portion 1*a* integrally formed therewith, and the inner rotor 2 has a second cylindrical portion 2*a* integrally formed therewith. In the present embodiment, the first cylindrical portion 1*a* is configured to be fitted onto the second cylindrical portion 2*a*.

As described above, by integrally forming the first cylindrical portion 1*a* or the second cylindrical portion 2*a* with the front plate 11 or the inner rotor 2, a number of components can be reduced. In addition, as the number of components is reduced, a number of assembly steps is reduced. Especially, for example, by integrally forming the second cylindrical portion 2*a* with the inner rotor 2, centering accuracy of the second cylindrical portion 2*a* is remarkably improved as compared with the conventional device having a centering member. As a result, attachment of the camshaft 3, which will be described later, is further facilitated.

Focusing on a shape of the inner rotor 2, in the present embodiment, the inner rotor 2 is in a shape of an approximate column, as shown in FIG. 1. In this case, an annular recess 27 in which the torsion spring 6 is disposed may be, for example, formed by grinding one flat face of the column. If the column shape is enough as a basic shape of the inner rotor 2, it can be obtained by firstly shaping an elongated member with extrusion molding of aluminum or the like, and then cutting the member into pieces each having a predetermined size. Therefore, producibility of the valve timing controller is improved.

As shown in FIG. 1, on an opposite side of the inner rotor 2 to a side of the second cylindrical portion 2*a*, the connection recess 21 is provided for attaching the camshaft 3. The camshaft 3 is inserted into a shaft receiving hole 13*a* formed in the rear plate 13 and a distal end of the camshaft 3 is inserted into and fixed to the connection recess 21. In a center portion of the inner rotor 2, for example, a hole having an inner diameter larger than an outer diameter of the cam bolt 31 is formed so that a bolt for the camshaft 3 (hereinafter, referred to as "cam bolt") 31 can be inserted. Into the hole, the cam bolt 31 is inserted from a front side and screwed with the camshaft 3.

In an end portion of the camshaft 3, a cylindrical space 32 having an inner diameter larger than the outer diameter of the cam bolt 31 is formed. A space between an inner face of the inner rotor 2 and an outer face of the cam bolt 31 together with a space between a wall face forming the cylindrical space 32 of the camshaft 3 and the outer face of the cam bolt 31 is utilized as, for example, the advance oil passage 81 for supplying and discharging the operating oil to and from the advance chamber 51. It should be noted that the retard oil passage 82 for supplying and discharging the operating oil to and from the retard chamber 52 is separately formed inside the camshaft 3, as shown in FIG. 1.

The cam bolt 31 comes into contact with an end face of the second cylindrical portion 2*a* of the inner rotor 2. In this manner, the end face of the second cylindrical portion 2*a* functions as seat for fastening bolt. In addition, the contact of a head of the bolt against the second cylindrical portion 2*a* forms an oil seal in the advance oil passage 81. It should be noted that an oil seal 33 may be provided between the second cylindrical portion 2*a* and the cam bolt 31, as shown in FIG. 1.

In the device of the present invention, in order to facilitate the attachment of the camshaft 3 to the inner rotor 2, shape and size of each part are set in the following manner.

Figure 3:
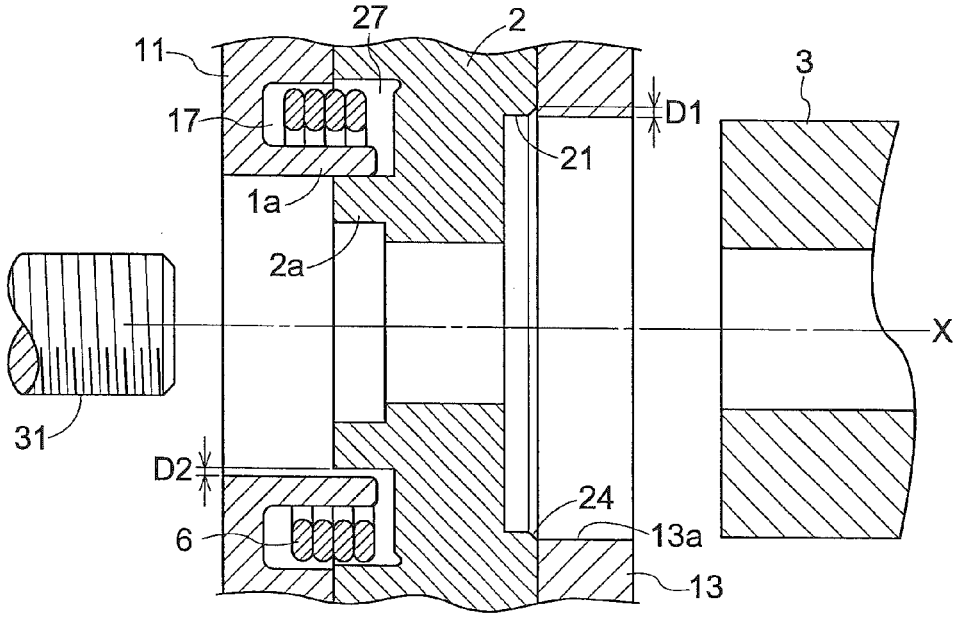
FIG. 3 is a diagram showing an assembly of the valve timing controller according to the first embodiment.

As shown in FIG. 3, an opening of the connection recess 21 formed in the inner rotor 2 is provided with a chamfer 24, which is for facilitating insertion of the end portion of the camshaft 3. In addition, the chamfer 24 is configured in such a manner that an outer contour of the chamfer 24 is always positioned outside the shaft receiving hole 13*a* provided in the rear plate 13.

Specifically, an opening diameter of the chamfer 24, i.e. a maximum outer diameter of the connection recess 21 formed for the insertion of the camshaft 3 is made lager than an inner diameter of the shaft receiving hole 13*a* formed in the rear plate 13, so that the camshaft 3 can be inserted. Further, it is preferable that a difference D1 between the maximum outer diameter of the connection recess 21 and the inner diameter of the shaft receiving hole 13*a* is set larger than a gap size D2 in the radial direction between the first cylindrical portion 1*a* and the second cylindrical portion 2*a*.

With the present configuration, by simply inserting the camshaft 3 into the shaft receiving hole 13*a*, the distal end of the camshaft 3 is brought into contact with the chamfer 24, and an effect of aligning the inner rotor 2 can be obtained.

It should be noted that, when an inner diameter of the connection recess 21 formed in the inner rotor 2 and the inner diameter of the shaft receiving hole 13*a* formed in the rear plate 13 are compared, the inner diameter of the shaft receiving hole 13*a* is slightly larger. The reason for this is that the camshaft 3 should be received by the connection recess 21 of the inner rotor 2 without forming a gap, and at the same time, the camshaft 3 should be supported by the shaft receiving hole 13*a* of the rear plate 13 with a predetermined gap.

In addition, with the present configuration, the end portion of the camshaft 3 can be made in a simple cylindrical shape and the structure of the end portion of the camshaft 3 can be simplified. Accordingly, the valve timing controller can be reasonably obtained.

In the present configuration, a bearing is formed between the camshaft 3 and the rear plate 13. In this manner, by aligning the centers of the housing 1 and the inner rotor 2 with the camshaft 3, and by setting the basis of the rotation of both the inner rotor 2 and the housing 1 to the camshaft 3, assembly accuracy of the valve timing controller can be enhanced.

Second Embodiment

Figure 4:
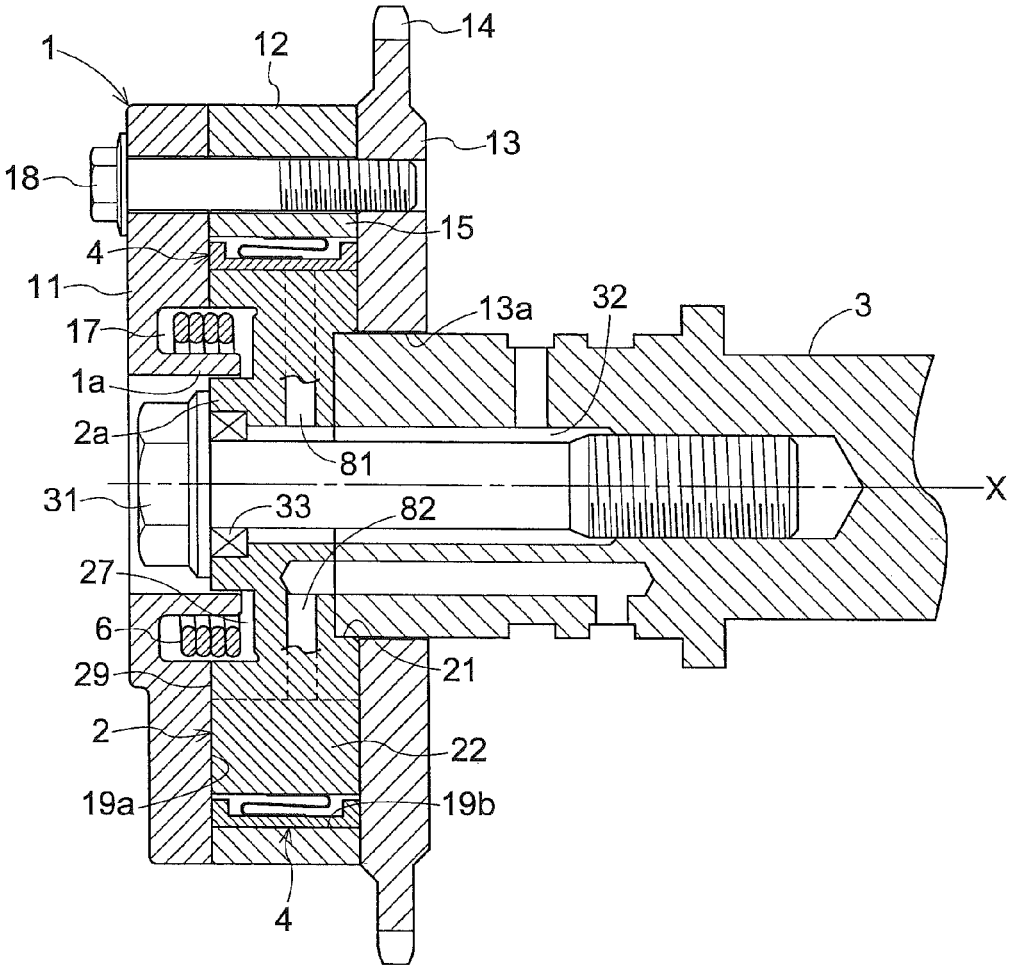
FIG. 4 is a cross-sectional side view of the valve timing controller according to the second embodiment.

FIG. 4 shows an embodiment in which the housing 1 has separate members.

Herein, the front plate 11 and the peripheral wall 12 are formed as separate members. In this manner, when the housing 1 is formed of a plurality of components, not only time and effort for manufacturing each component increase, but also quality maintenance of a product as a whole becomes difficult due to accumulation of error in work accuracy of each component.

However, depending on the shape of the component, there are some cases in which the accuracy of the component is improved and the accuracy and function of the product as a whole are improved, if the components are separately manufactured. In the case of the present device, in order to prevent leakage of the operating oil from between the advance chamber 51 and the retard chamber 52, it is necessary that an inward face 19*a* of the front plate 11 be brought into slidable contact with a frontward face 29 of the inner rotor 2, and an inner periphery 19*b* of the peripheral wall 12 be brought into slidable contact with the sealing member 4 provided in the second projection 22. For this purpose, the inward face 19*a* of the front plate 11 should be made as flat as possible, and the inner periphery 19*b* of the peripheral wall 12 should be made as cylindrical as possible. In such a case, finishing accuracy or the like of each face is improved, if each member is separately manufactured as an article having a simple shape. As a result, when product quality, production cost and the like together are taken into consideration, producibility as a whole can be enhanced.

Third Embodiment

Figure 5:
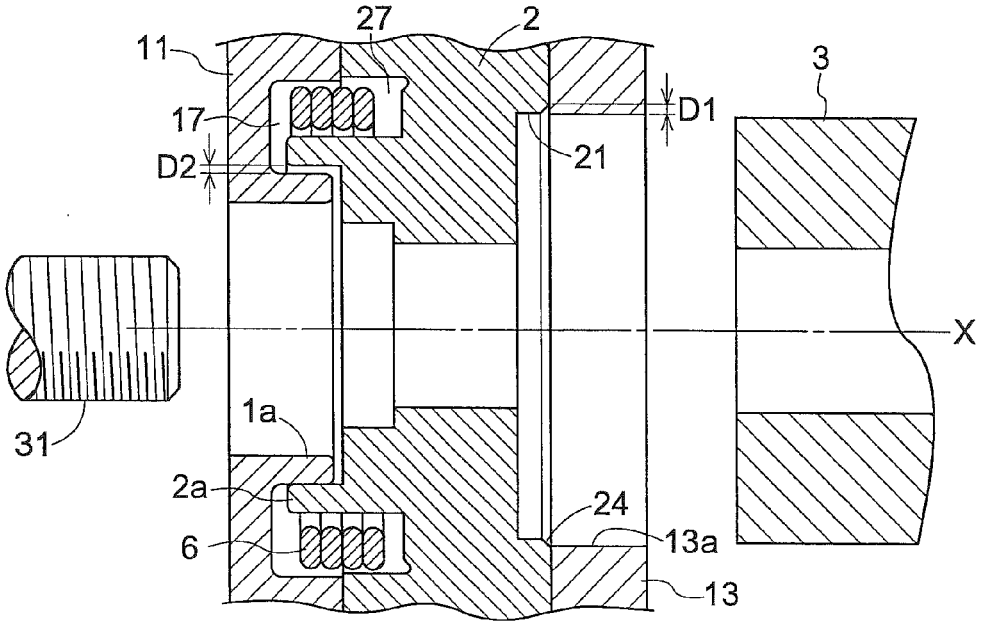
FIG. 5 is a diagram showing an assembly of the valve timing controller according to a third embodiment.

As shown in FIG. 5, an insertion configuration, i.e. inside-outside position, between the first cylindrical portion 1*a* formed in the front plate 11 and the second cylindrical portion 2*a* formed in the inner rotor 2 may be reversed. In this case, for example, as shown in FIG. 5, the second cylindrical portion 2*a* of the inner rotor 2 is responsible for a wall potion defining a space for the torsion spring 6, and a height of the first cylindrical portion 1*a* of the front plate 11 can be made lower. As a result, the shape of the front plate 11 can be made more planar and simplified, and thus possible improvement of producibility is enhanced.

Other Embodiments

The first cylindrical portion 1*a* may be formed in the rear plate 13 of the housing 1, instead of the front plate 11.

In addition, it suffices if the first cylindrical portion 1*a* and the second cylindrical portion 2*a* overlap with each other in the radial direction. Therefore, it does not matter whether or not the first cylindrical portion 1*a* protrudes relative to the front plate 11, and it does not matter either, whether or not the second cylindrical portion 2*a* is protrudes relative to the inner rotor 2.

Moreover, the inner rotor 2 or the housing 1 may be produced by extrusion molding or injection molding using aluminum or the like, and alternatively, produced by sintering various metals.

The valve timing controller according to the present invention can be used as valve opening-closing controller on an intake side or an exhaust side of the internal combustion engine.

REFERENCE SIGNS LIST

1*a* First cylindrical portion
2*a* Second cylindrical portion
3 Camshaft
4 Sealing member
6 Torsion spring
11 Front plate
13 Rear plate
51 Advance chamber
52 Retard chamber
90 Crankshaft
E Internal combustion engine

The invention claimed is:

1. A valve timing controller comprising:

a driving-side rolling body configured to rotate synchronously with a crankshaft of an internal combustion engine;

a driven-side rolling body which is coaxially held in the driving-side rolling body through a sealing member and is configured to rotate in a unified manner with a camshaft for opening/closing a valve of the internal combustion engine, relative to the driving-side rolling body, the driven-side rolling body possessing a first end face and a second end face, the second end face being at an end of the driven-side rolling body opposite to the first end face and being closer to the camshaft than the first end face;

an advance chamber configured to move a relative rotation phase of the driven side rolling body relative to the driving-side rolling body in an advance direction by a volume increase of the advance chamber through an operating oil supply, and a retard chamber configured to move the relative rotation phase in a retard direction by a volume increase of the retard chamber through an operating oil supply, the advance chamber and the retard chamber being formed of the driving-side rolling body and the driven-side rolling body;

a torsion spring which is disposed in a space formed between a front plate or a rear plate of the driving-side rolling body and the driven-side rolling body and is configured to bias at all times the driving-side rolling body and the driven-side rolling body in the advance direction or the retard direction;

a first cylindrical portion provided in the front plate or the rear plate and a second cylindrical portion representing an inner diameter-side wall of an annular groove formed in the first end face of the driven-side body on the opposite side of the camshaft, the first and second cylindrical portions being insertable into each other in an axial direction;

a recess in the second end face of the driven-side rolling body, the recess possessing an opening, an end portion of the camshaft being insertable into the recess; and a chamfer at the opening of the recess, the chamfer possessing an opening diameter larger than an inner diameter of a hole in the rear plate into which the camshaft is insertable. the inner diameter of the hole being larger than an inner diameter of the recess.

2. The valve timing controller according to claim 1, wherein the first cylindrical portion is set outside the second cylindrical portion.

3. The valve timing controller according to claim 1, wherein an inner periphery of a hole formed in the rear plate and an outer diameter face of the camshaft constitute a bearing.

4. The valve time controller according to claim 1, wherein the opening diameter of the recess exceeds the inner diameter of the hole in the rear plate by a first distance;

the inner surface diameter of the first cylinder exceeds the outer surface diameter of the second cylinder by a second distance; and the first distance is greater than the second distance.

5. A valve timing controller comprising:

a driving-side rolling body configured to rotate synchronously with a crankshaft of an internal combustion engine, the driving-side rolling body comprising a front plate and a rear plate;

a driven-side rolling body which is coaxially held in the driving-side rolling body through a sealing member and is configured to rotate in a unified manner with a camshaft for opening/closing a valve of the internal combustion engine, relative to the driving-side rolling body, the driven-side rolling body possessing a first end face and a second end face, the second end face being at an end of the driven-side rolling body opposite to the first end face and being closer to the camshaft than the first end face;

an advance chamber configured to move a relative rotation phase of the driven-side rolling body relative to the driving-side rolling body in an advance direction by a volume increase of the advance chamber through an operating oil supply, and a retard chamber configured to move the relative rotation phase in a retard direction by a volume increase of the retard chamber through an operating oil supply, the advance chamber and the retard chamber being formed by the driving-side rolling body and the driven-side rolling body;

a torsion spring positioned in a space formed between the front plate or the rear plate of the driving-side rolling body and the driven-side rolling body and configured to bias the driving-side rolling body and the driven-side rolling body in the advance direction or the retard direction;

a first cylindrical portion in the front plate or the rear plate, the first cylindrical portion possessing an inner surface and an outer surface;

a second cylindrical portion in the first end face of the driven-side rolling body, the second cylindrical portion possessing an outer surface;

the second cylindrical portion being positioned in the first cylindrical portion in an axially-overlapping position so the inner surface of the first cylindrical portion faces the outer surface of the second cylindrical portion; and the torsion spring being positioned radially outward of the first and second cylindrical portions.

6. The valve timing controller according to claim 5, wherein the torsion spring possesses an inner spring surface and the torsion spring is positioned with the inner spring surface facing the outer surface of the first cylindrical portion.

7. The valve timing controller according to claim 5, wherein an inner periphery of a hole formed in the rear plate and an outer peripheral surface of the camshaft constitute a bearing.

8. The valve time controller according to claim 5, wherein the second end face of the driven-side rolling body possesses a recess, an end portion of the camshaft being insertable into the recess, the recess including an opening with an opening diameter, and the recess including an inner diameter being smaller than the opening diameter;

the rear plate of the driving-side rolling body possesses a hole with an inner diameter, the camshaft being insertable into the hole;

the inner diameter of the hole of the rear plate being larger than the inner diameter of the recess; and the inner diameter of the hole of the rear plate being smaller than the opening diameter of the recess.

9. The valve timing controller according to claim 8, wherein the inner surface of the first cylinder possess an inner surface diameter and the outer surface of the second cylinder possesses an outer surface diameter;

the opening diameter of the recess exceeds the inner diameter of the hole in the rear plate by a first distance;

the inner surface diameter of the first cylinder exceeds the outer surface diameter of the second cylinder by a second distance; and the first distance is greater than the second distance.

* * * * *